US008424216B2

(12) United States Patent
Huss et al.

(10) Patent No.: US 8,424,216 B2
(45) Date of Patent: Apr. 23, 2013

(54) DUAL-SIDE ENGRAVING SYSTEM

(75) Inventors: James Francis Huss, Scottsdale, AZ (US); Bryan Keith Solace, Chandler, AZ (US)

(73) Assignee: The Hillman Group, Inc., Tempe, AZ (US)

( * ) Notice: Subject to any disclaimer, the term of this patent is extended or adjusted under 35 U.S.C. 154(b) by 585 days.

(21) Appl. No.: 12/614,899

(22) Filed: Nov. 9, 2009

(65) Prior Publication Data

US 2011/0110741 A1 May 12, 2011

(51) Int. Cl.
*B43L 13/00* (2006.01)

(52) U.S. Cl.
USPC ..... 33/18.1; 33/32.5

(58) Field of Classification Search ..... 33/18.1, 33/18.2, 32.5, 1 M, DIG. 2; 409/199, 200, 409/204–206, 88–89, 163–165
See application file for complete search history.

(56) References Cited

U.S. PATENT DOCUMENTS

| | | | | | |
|---|---|---|---|---|---|
| 3,639,993 | A | * | 2/1972 | Sartorio | 33/572 |
| 3,803,979 | A | * | 4/1974 | Young | 409/88 |
| 3,925,602 | A | * | 12/1975 | Doi et al. | 358/3.32 |
| 3,927,599 | A | * | 12/1975 | Raymond | 409/90 |
| 5,093,672 | A | * | 3/1992 | Gascuel et al. | 346/139 R |
| 5,232,321 | A | * | 8/1993 | Suzuki | 409/107 |
| 5,235,519 | A | * | 8/1993 | Miura | 700/233 |
| 5,493,965 | A | * | 2/1996 | Lizarazu | 101/3.1 |
| 5,504,301 | A | * | 4/1996 | Eveland | 219/121.67 |
| 5,512,005 | A | * | 4/1996 | Gulling | 451/29 |
| 5,569,003 | A | * | 10/1996 | Goldman et al. | 409/132 |
| 5,594,991 | A | * | 1/1997 | Therond | 33/18.1 |
| 5,810,526 | A | * | 9/1998 | Hirai | 409/131 |
| 6,046,563 | A | * | 4/2000 | Moreyra | 318/567 |
| 6,817,814 | B2 | * | 11/2004 | Mueller | 409/132 |
| 6,839,451 | B2 | * | 1/2005 | Campbell et al. | 382/100 |
| 6,976,315 | B2 | * | 12/2005 | Hoshiyama | 33/18.1 |
| 7,114,894 | B2 | * | 10/2006 | Mueller et al. | 409/84 |
| 7,290,978 | B2 | * | 11/2007 | Tran | 414/763 |
| 7,384,527 | B2 | * | 6/2008 | Goldberg et al. | 204/606 |
| 7,853,353 | B1 | * | 12/2010 | Hagen et al. | 700/235 |
| 7,894,935 | B1 | * | 2/2011 | Hagen et al. | 700/235 |
| 8,050,796 | B1 | * | 11/2011 | Hagen et al. | 700/235 |
| 2002/0030318 | A1 | | 3/2002 | Hoshiyama | |

FOREIGN PATENT DOCUMENTS

EP 0296723 12/1988

OTHER PUBLICATIONS

PCT Search Report mailed Jul. 19, 2011 in PCT/US2010/051841 including a PCT Written Opinion of the International Searching Authority.

TagWorks engraving machine figures and description, 2 pages, Compiled on Oct. 29, 2009.

* cited by examiner

*Primary Examiner* — Peter Macchiarolo
*Assistant Examiner* — Tania Courson
(74) *Attorney, Agent, or Firm* — Finnegan, Henderson, Farabow, Garrett & Dunner LLP

(57) ABSTRACT

An engraving system operable to engrave user-loaded items is provided. The engraving system may have a housing, an engraver located within the housing, and a carrier configured to receive from a user a cartridge holding then item to be engraved and to position the cartridge relative to the engraver. The carrier may be configured to engrave the item via windows in the cartridge, and to flip the cartridge relative to the engraver for engraving on multiple sides of the item.

41 Claims, 9 Drawing Sheets

DUAL-SIDE ENGRAVING SYSTEM

TECHNICAL FIELD

The present disclosure is directed to an engraving system and, more particularly, to an engraving system configured to engrave opposing sides of an item loaded into the engraver by a user.

BACKGROUND

Engravers can be found in many retail locations that function in a manner similar to vending machines to inscribe information on items purchased from the machine. These engravers can include collections of items to be engraved, for example pet id tags and key chains. When a customer pays for one of the items and dictates a personal message to the machine, for example a pet's name, the owner's address, or a phone number, the purchased item is loaded into position below an engraver and the personal message is inscribed on one side of the item.

Although suitable for some applications, these machines can be large and take up a great deal of floor space. In addition, the variety of items available for selection can be limited to the holding capacity of the engraving machine, and the machine may only be capable of inscribing a single side of the item without manual repositioning of the item.

The disclosed engraving system is directed to overcoming one or more of the problems set forth above and/or other problems of the prior art.

SUMMARY

In one aspect, the disclosure is directed toward an engraving system operable to engrave a user-loaded item. The engraving system may include a housing, an engraver located within the housing, and a carrier configured to receive from a user a cartridge holding the item to be engraved and to position the cartridge relative to the engraver. The carrier may be configured to engrave the item via windows in the cartridge, and to flip the cartridge relative to the engraver for engraving on multiple sides of the item.

In another aspect, the disclosure is directed toward another engraving system operable to engrave a user-loaded item. This engraving system may include a housing, an engraver located within the housing, a base support movable in a direction from an opening in the housing towards the engraver, and a carrier rotatably connected to the base support and configured to receive from a user the item to be engraved and to position the item relative to the engraver. The engraving system may also include at least one bearing located under the base support to support movement of the base support, and at least one roller located under the carrier to support the carrier during engraving operations.

In yet another aspect, the disclosure is directed toward another engraving system operable to engrave a user-loaded item. This engraving system may include a housing, an engraver located within the housing, a carrier configured to receive from a user a cartridge holding the item to be engraved and to position the cartridge relative to the engraver, and a reader situated to read coded indicia associated with the item as the carrier moves the item from an opening of the housing towards the engraver.

In still another aspect, the disclosure is directed toward a method of engraving an item. The method may include receiving from a user a cartridge containing the item to be engraved, positioning the item relative to an engraver, and reading from the cartridge coded indicia corresponding to characteristics of the item as the cartridge is positioned relative to the engraver. The method may further include flipping the cartridge relative to the engraver for engraving on multiple sides of the item via windows in the cartridge.

DETAILED DESCRIPTION

Figure 1:
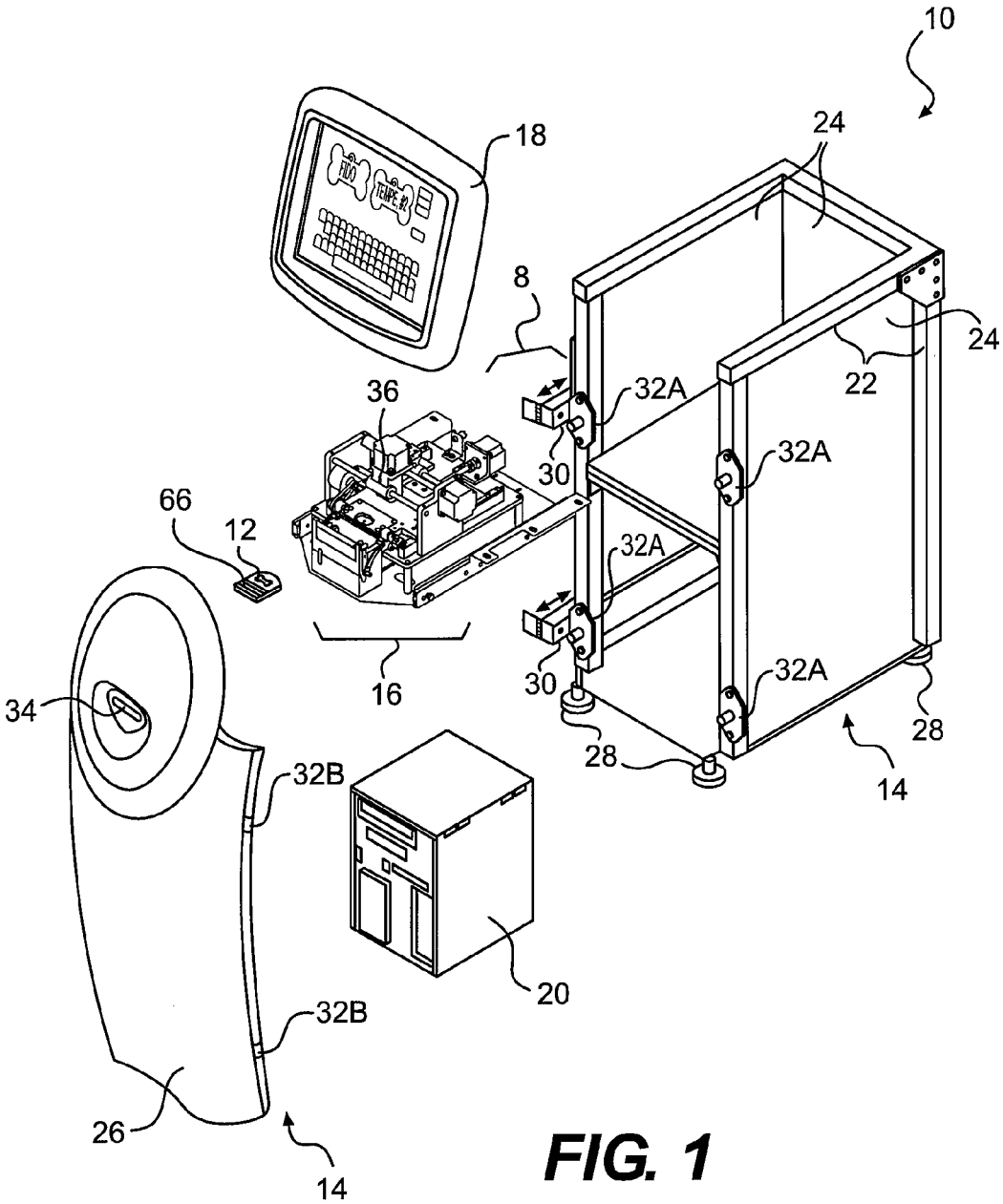
FIG. 1 is an exploded view illustration of an exemplary disclosed engraving system.

FIG. 1 illustrates an engraving system 10 utilized to inscribe an item 12. For purposes of this disclosure, the term "item" is intended to include any products or goods that are or may be sold with a personalized inscription. Examples of such items include, but are not limited to, pet id tags, key chains, tourism mementos, holiday gifts, tournament plaques, etc. Engraving system 10 may include a housing 14 at least partially enclosing an engraving subassembly 16, an operator interface 18, and a controller 20. Controller 20 may control operations of engraving subassembly 16 to inscribe item 12 based at least partially on user instructions received via operator interface 18.

Housing 14 may be fabricated of a solid construction and may completely enclose the moving components of engraving system 10. Housing 14 may include a frame 22, one or more side panels 24, and a door 26. Frame 22 may be supported by adjustable feet 28, with side panels 24 being fixedly connected to frame 22. Door 26 may be mounted on hinges 30 that are located on an outer edge of frame 22. In one embodiment, hinges 30 may be slidingly connected to frame 22 such that curved portions of door 26 may clear any obstructions during opening and closing movements. One or more alignment features 32A, for example pins located on frame 22, may engage one more corresponding alignment features 32B, for example recesses located within door 26, to help ensure proper closing of door 26. An opening 34 in door 26 may allow a user to insert item 12 into and retrieve item 12 from engraving subassembly 16.

Figure 2:
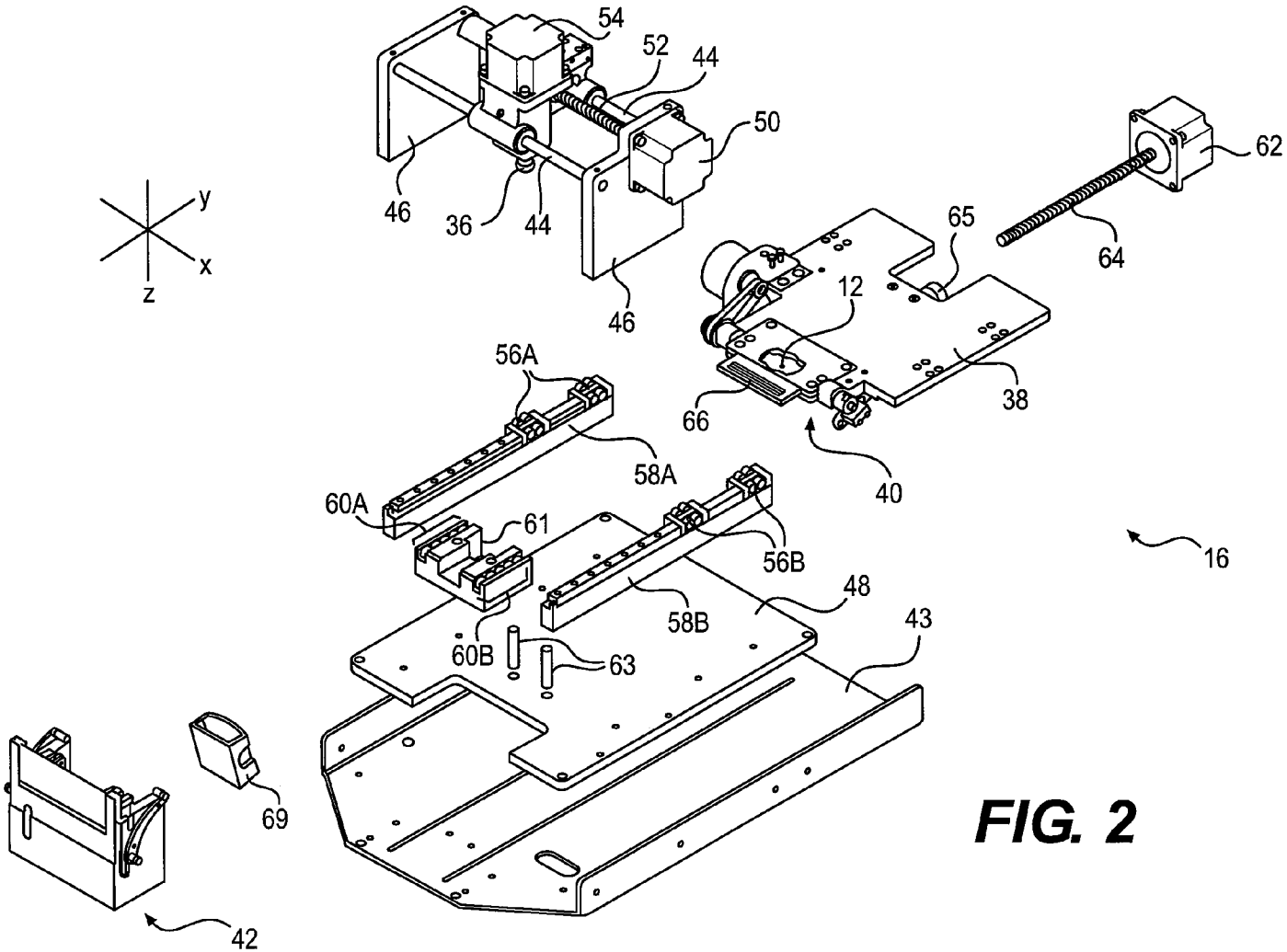
FIG. 2 is an exploded view illustration of an engraving subassembly that may be used in conjunction with the engraving system of FIG. 1.

Although engraving subassembly 16 is intended for use with an engraver 36, it is contemplated that the engraving subassembly 16 may alternatively be utilized with a printer or any other instrument capable of writing, printing, or engraving text or figures onto the surface of item 12. The preferred engraver 36 is a scribe engraver, although any type of engraver known in the art such as, for example, a milling engraver or a laser engraver, may similarly be used. As illustrated in FIG. 2, engraving subassembly 16 may also include a base support 38, a carrier 40, and a door mechanism 42. Base support 38 may be movable in a direction extending between door mechanism 42 and engraver 36, referred to as the Y-direction, to position carrier 40 relative to engraver 36 for subsequent engraving processes. A rack 43 may secure base support 38, engraver 36, and door mechanism 42 within housing 14.

Engraver 36 may be mounted to rack 43 by way of a support structure that provides for movement of engraver 36 in two dimensions, referred to as the X- and Z-directions. The support structure for engraver 36 may include two guides 44 supported by two vertical support members 46 that rest on and are fixedly connected to a bottom plate 48. Bottom plate 48 may be fixedly connected to rack 43.

Movement of engraver 36 in the X-direction may be controlled by a first stepper motor 50 that is mounted on one of vertical support members 46. First stepper motor 50 may be connected to engraver 36 by way of a lead screw 52. In one embodiment, lead screw 52 may be connected to first stepper motor 50 and/or to engraver 36 by way of an anti-backlash device (not shown) such as a spring-loaded nut that receives lead screw 52. First stepper motor 50 may turn lead screw 52 to thereby cause engraver 36 to move along guides 44 in the X-direction. The amount of X-direction movement generated by first stepper motor 50 may be governed by controller 20 (referring to FIG. 1).

Movement of engraver 36 in the Z-direction may be controlled by a second stepper motor 54 that is mounted to guides 44. Engraver 36 may be threadingly connected to a lead screw (not shown) of second stepper motor 54, which results in movement of engraver 36 in the Z-direction as second stepper motor 54 rotates the lead screw. The amount of Z-direction movement generated by second stepper motor 54 may be governed by controller 20 (referring to FIG. 1).

Table 38 may be positioned vertically between engraver 36 and rack 43, and horizontally between vertical support members 46. As shown in FIG. 2, base support 38 and connected carrier 40 may be supported by sets of bearings. In particular, a first set of bearings 56A may be arranged under base support 38 in the Y-direction to support one edge of base support 38, while a second set of substantially identical bearings 56B may be arranged under base support 38 in the Y-direction to support an opposing edge of base support 38. Both sets of bearings 56A, 56B may be connected to base support 38 and arranged to ride on longitudinal support rails 58A and 58B, respectively. Support rails 58A, 58B may rest on and be fixedly connected to bottom plate 48 to extend in the Y-direction. It is contemplated that, in an alternative embodiment, bearings 56A and 56B may be replaced with rollers or another type of bearings, if desired.

First and second sets of rollers 60A and 60B may similarly support carrier 40 during engraving operations. That is, first set of rollers 60A may be arranged in the Y-direction under one edge of carrier 40, while second set of rollers 60B may be arranged in the Y-direction under an opposing edge of carrier 40. Both first and second sets of rollers 60A, 60B may be mounted within a carrier block 61 that is connected to bottom plate 48. In one embodiment, adjustment mechanisms, for example dowel pins 63 and/or set screws (not shown), may be located for selective height adjustment of first and second sets of rollers 60A, 60B relative to engraver 36, if desired. It is contemplated that, in an alternative embodiment, rollers 60A and 60B may be replaced with bearings, if desired.

As illustrated in FIG. 2, movement of base support 38 in the Y-direction may be controlled by a third stepper motor 62. Third stepper motor 62 may be connected to a lead screw 64 that is engaged with a threaded structure 65 of base support 38. In one embodiment, threaded structure 65 may embody an anti-backlash device such as a spring-loaded nut that receives lead screw 64. Lead screw 64 may be turned relative to threaded structure 65 by third stepper motor 62 to move base support 38 along first and second sets of bearings 56A, 56B in the Y-direction with respect to engraver 36. The amount of Y-direction movement generated by third stepper motor 62 may be governed by controller 20 (referring to FIG. 1).

Carrier 40 may be configured to receive a cartridge 66 having a fixture that securely holds item 12 during an engraving process. In the present embodiment, item 12 may be mounted within a relief-type fixture (not shown) of cartridge 66. It should be noted, however, that the fixture of cartridge 66 is not limited to a relief or any particular securing mechanism. The present disclosure contemplates numerous fixtures, including an arrangement wherein the fixture is above the surface of item 12, or both above and below the surface.

Engraving system 10 may provide a series of cartridges 66 to carry a wide assortment of items 12. The depth, width, length, and general shape of the relief in each cartridge 66 may be dependent on the particular item 12 held therein, while outer dimensions of cartridges 66 may remain substantially constant regardless of the item 12. Each relief may generally match the shape of the item 12 held therein so that item 12 will not move with respect to cartridge 66 during the engraving process. Each cartridge 66 may secure item 12 within the relief such that at least a portion of a surface of item 12 is exposed for engraving.

Each item 12 may be identified by a unique product code. The product code for each item 12 may uniquely identify each item 12 by the item's depth, length, width, shape, and the dimensions and location of the item's surface area that is available for engraving. The product code may be displayed on cartridge 66 and/or contained in coded indicia, for example a barcode 68 (shown only in FIG. 4E), affixed to the particular cartridge 66.

A reader 69 may be connected to engraving system 10 to read barcode 68 on cartridge 66 and to communicate the product code to controller 20. Preferably, reader 69 is not activated until cartridge 66 is secured within carrier 40 and/or until carrier 40 has started movement back towards engraver 36 for a subsequent engraving procedure. Activating reader 69 in this manner may help to reduce the likelihood that a user will scan a barcode 68 from a cartridge 66 that contains an item 12 different from the item 12 actually being engraved.

Figure 3:
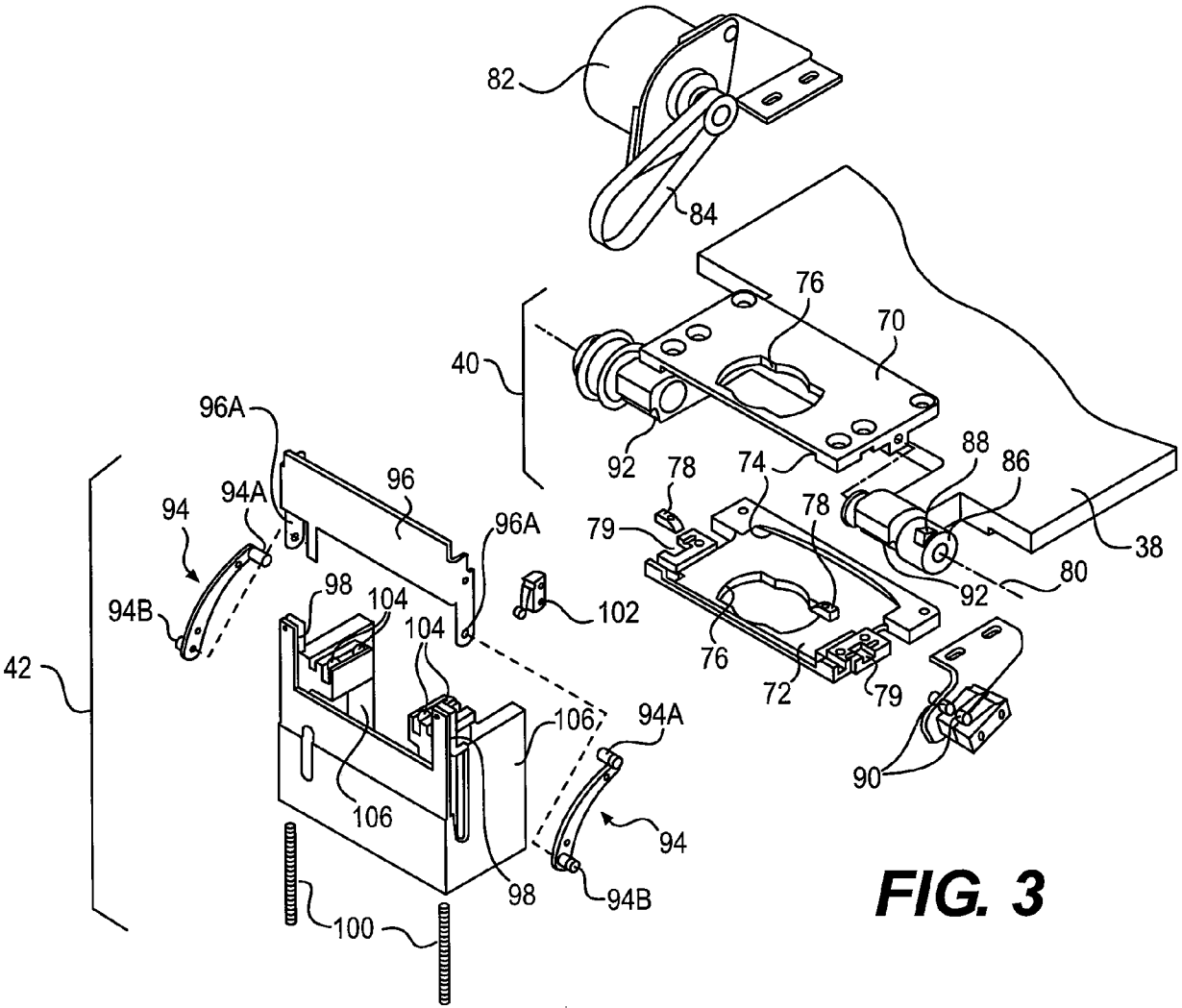
FIG. 3 is an exploded view illustration of a portion of the engraving subassembly of FIG. 2.

As illustrated in FIG. 3, carrier 40 may be provided with an upper plate 70 and a lower plate 72 that together form a slot 74 configured to slidingly receive cartridge 66 and to secure cartridge 66 in place (i.e., to inhibit movement and/or rotation) during the engraving process. Both upper and lower plates 70, 72 may each include a window 76 that provides access for engraver 36 to opposing sides of item 12. In one example, carrier 40 may be provided with pawls 78 or other similar locking mechanisms that engage and lock cartridge 66 from unintended movements when cartridge 66 is fully inserted into slot 74. Pawls 78 may ride in corresponding grooves 79 located in one or both of upper and lower plates 70, 72, and be spring-loaded to engage corresponding recesses or other features (not shown) located in the sides of cartridge 66. During installing and retrieving movements of cartridge 66, pawls 78 may be pushed out of the recesses against the spring bias to allow cartridge 66 to move, as will be described in more detail below. It is contemplated that a switch or sensor (not shown) may also be associated with slot 74 and/or pawls 78 to generate a signal indicative of a locked status of cartridge 66 within slot 74, if desired.

During operation of engraving system 10, carrier 40 may be moved towards door mechanism 42 to receive cartridge 66 from a user, and moved back into an engraving position in preparation for a subsequent engraving process. In particular, carrier 40 may be connected to base support 38 at an end opposite third stepper motor 62 (referring to FIG. 2). In this arrangement, movement of base support 38 in the Y-direction caused by third stepper motor 62 may also affect movement of carrier 40 towards and away from door mechanism 42.

Carrier 40 may also be flipped such that opposing sides of item 12 are exposed to engraver 36 for engraving purposes. Specifically, carrier 40 may be rotatably connected to base support 38 along an axis 80, and operatively connected to a fourth stepper motor 82. In one example, fourth stepper motor 82 may be connected to carrier 40 by way of a belt 84 or a chain. As fourth stepper motor 82 rotates, carrier 40 can be caused to rotate about axis 80 and flip cartridge 66 such that windows 76 on opposing sides of item 12 are positioned for engraving.

In one embodiment, a cam mechanism 86 having one or more lobes 88 may be fixedly connected to rotate with carrier 40 about axis 80. Lobes 88 may selectively engage one or more switches 90 mounted to base support 38 during the rotation of carrier 40. In this configuration, as carrier 40 and connected cam mechanism 86 are rotated by fourth stepper motor 82, switches 90 may be engaged by lobes 88 to generate signals indicative of a flip angle of carrier 40. The signals generated by switches 90 may then be utilized by controller 20 to regulate the operation of fourth stepper motor 82 such that carrier 40 is positioned appropriately relative to engraver 36 during the subsequent engraving process. That is, based on the signals from switches 90, controller 20 may regulate operation of fourth stepper motor 82 such that the surface of item 12 to be inscribed is positioned in a plane substantially parallel to the X-Y plane of engraver 36 (i.e., such that the angle between carrier 40 and base support 38 is reduced).

Door mechanism 42 may include a door 96 opened by the movement of base support 38 in the Y-direction. In particular, as can be seen in FIG. 3, base support 38 may be provided with cup-like recesses 92 on either side of carrier 40. Each of recesses 92 may be configured to receive the free ends 94A of paired lever arms 94 that are pivotally connected at fixed ends 94B to opposing downward extensions 96A of door 96. Door 96 may be mounted on each side within opposing vertical grooves 98, and biased upward by one or more springs 100 towards a closed position at which user access via opening 34 (referring to FIG. 1) is substantially blocked. As base support 38 moves towards door mechanism 42, recesses 92 may receive free ends 94A of lever arms 94 and force free ends 94A to roll along an upper surface of associated side structures 106 towards door 96 during further movement of base support 38. Because of the curved nature of lever arms 94 and their pivotal connection to door 96, the further movement of base support 38 towards door 96 may force the connected ends 94B of lever arms 94 downward to move door 96 within vertical grooves 98 against the bias of springs 100. As base support 38 retracts back towards engraver 36, the spring bias may return door 96 upward towards its closed position. It is contemplated that a switch 102 may be associated with door 96, if desired, to indicate to controller 20 when door 96 is opened and/or closed.

In one embodiment, door mechanism 42 may be configured to support carrier 40 when carrier 40 is positioned to receive cartridge 66 from a user. In particular, as can be seen in FIG. 3, door mechanism 42 may include one or more rollers 104 located in supporting side structures 106 of door mechanism 42. In this configuration, when carrier 40 is extended towards opening 34, lower plate 72 of carrier 40 may ride on rollers 104.

Controller 20 may be provided to govern operations of engraving system 10. In one embodiment, controller 20 may govern all operations of engraving system 10, including receipt of information from operator interface 18 about a particular item 12 to be inscribe and the content of the inscription, as well as operation of first-fourth stepper motors 50, 54, 62, 82.

Controller 20 may include a device, for example a computer, that controls the operation of engraving system 10. In particular, controller 20 may include a memory, a secondary storage device, and a processor such as a central processing unit operatively connected to operator interface 18. The memory and secondary storage may store applications or information for execution and use by the processor. Controller 20 may optionally be connected to a network, such as the Internet.

In one embodiment, operator interface 18 may include a monitor having a touch sensitive screen. A user may touch certain areas of the screen in response to prompts from controller 20 to enter information about item 12 to be inscribed and the content of the inscription. Additionally, controller 20 or a user may access the interne or another electronic source of information to obtain text or figures to include in the inscription. In addition, operator interface 20 may include a scanner so that images or text may be scanned in and inscribed on item 12, if desired.

FIGS. 4A-4F illustrate components of engraving subassembly 16 at various positions during operation of engraving system 10. FIGS. 4A-4F will be discussed in more detail in the following section.

INDUSTRIAL APPLICABILITY

The disclosed engraving system may be utilized to engrave text and/or images on opposing sides of item 12. The operation of the engraving system of the present invention will now be described with reference to FIGS. 4A-4F.

The engraving process may begin when a customer/user selects an item 12 for engraving. Each item 12 available for engraving may be secured within a corresponding cartridge 66 having a relief of substantially the same shape. For example, a generally rectangular item, such as a pet id tag, could be secured in the exemplary cartridge 66 of FIG. 4A. In one embodiment, item 12 is already positioned within cartridge 66 and ready for customer use, although items 12 may alternatively be displayed and stored separate and apart from cartridges 66, if desired. In the latter case, items 12 will be inserted into cartridges 66 at a preliminary stage of the engraving process.

Figure 4A:
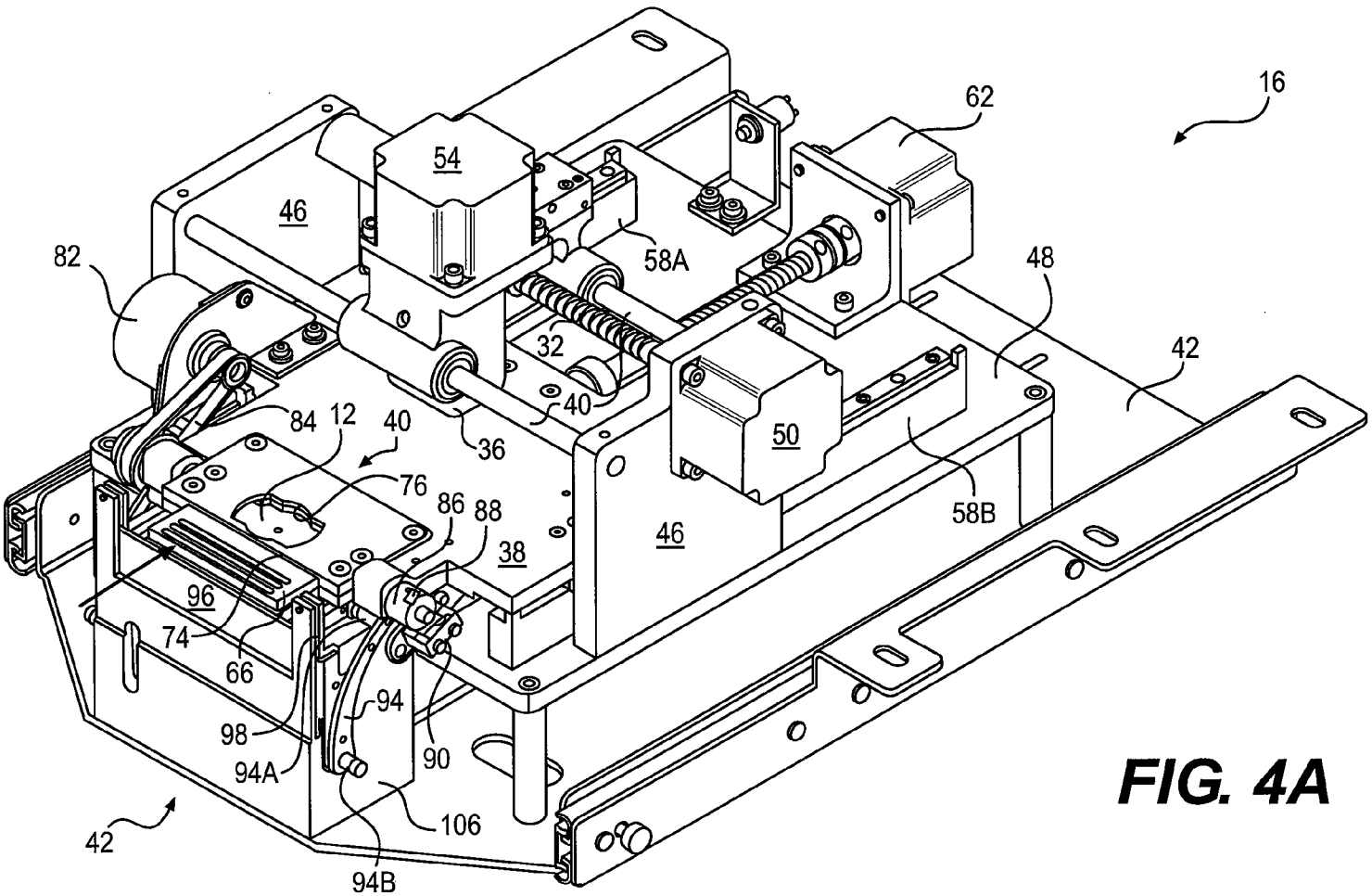
FIG. 4A is a pictorial illustration of the engraving subassembly of FIG. 2 at a first position during an engraving process.

After the desired item 12 is selected, the user may insert cartridge 66 containing the selected item 12 into carrier 40 by way of opening 34 (referring to FIG. 1). At this point in time, base support 38 has already been moved to open door 96 and position slot 74 of carrier 40 at opening 34 for receipt of cartridge 66. The user may push cartridge 66 through opening 34 and into slot 74 until confirmation of proper positioning is received. The confirmation may be an electronic signal, for example an audio or visual confirmation, or a tactile confirmation, for example the user may feel when cartridge 66 engages one or more soft detents (not shown). This operation is shown in FIG. 4A.

As the user inserts cartridge 66 into carrier 40, cartridge 66 may be locked into place by pawls 78 (referring to FIG. 3). In one embodiment, once cartridge 66 is locked into place, a signal indicative of the position and/or locked status of cartridge 66 may be generated and directed to controller 20. It is contemplated that a switch, optical sensor, or other device (not shown) may be utilized to monitor the status of cartridge 66 and to generate the associated signal, if desired. The signal may indicate to controller 20 that item 12 is positioned appropriately within slot 74 for subsequent engraving. In one embodiment, controller 20 may relay this information to the user to confirm the proper positioning by way of operator interface 18.

The user then inputs the desired inscription via operator interface 18. This step may be accomplished by manually typing the inscription into operator interface 18 by way of a touch screen keyboard. The content of the inscription may include both text and figures. The text of the inscription may be selected in any font or a combination of fonts, as well as in different languages.

After the content of the inscription is selected by the user, operator interface 18 may display a graphical representation of item 12 with the selected inscription overlaid on the representation. The representation may be presented as an exact replica of item 12 with the inscription shown exactly as it will appear on item 12. For dual-sided engraving operations, both sides of item 12 may be represented in a side-by-side format on operator interface 18 (shown in FIG. 1). The user may then opt to go forward with the engraving or may return to modify the content of the inscription. Because controller 20 may know the dimensions of the surface area of item 12 available for engraving, the user, in some embodiments, may not be allowed to input a message or design that is larger than the available inscribing area for the particular item 12.

Figure 4B:
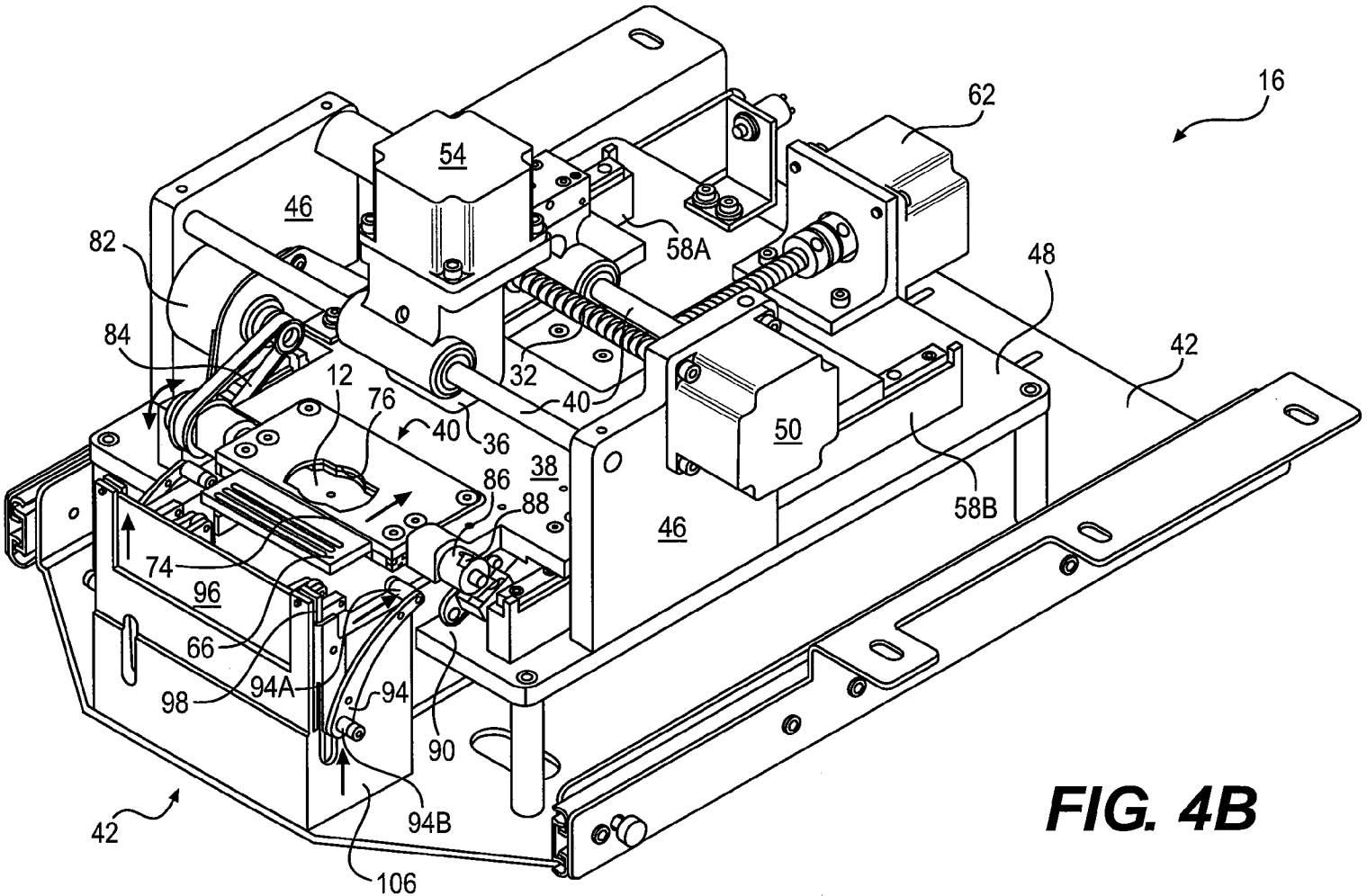
FIG. 4B is a pictorial illustration of the engraving subassembly of FIG. 2 at a second position during the engraving process.

Once cartridge 66 is appropriately positioned within slot 74 and the inscription message has been received, controller 20 may operate third stepper motor 62 to withdraw base support 38 and carrier 40 away from opening 34 and towards engraver 36. It is contemplated that base support 38 and carrier 40 may alternatively be withdrawn from opening 34 prior to receipt of the inscription message from the user. As carrier 40 is pulled away from opening 34, door 96 may be returned upward to its closed position by springs 100 (referring to FIG. 3), and barcode 68 (shown in FIG. 4E) may be received by reader 69. The closing of door 96 may activate switch 102. For safety reasons, controller 20, in some embodiments, may discontinue or delay the inscribing operation until confirmation of the closing of door 96 is received via switch 102. At about this same time, controller 20 may cause fourth stepper motor 82 to selectively rotate carrier 40 in either direction such that lobes 88 of cam mechanism 86 selectively engage switches 90 to cause switches 90 to generate signals indicative of the attitude of item 12 with respect to the movement plane of engraver 36 (i.e., signals indicative of the flip angle of cartridge 66 about axis 80 relative to base support 38). These signals may be utilized by controller 20 to regulate operation of fourth stepper motor 82 that adjusts the attitude of item 12 accordingly. These operations are shown in FIG. 4B.

Third stepper motor 62 may continue the Y-direction movement of base support 38 and carrier 40 (now holding cartridge 66 with item 12) until item 12 is correctly positioned below engraver 36. It should be noted that the exact positioning of item 12 relative to engraver 36 may be based at least partially on the characteristics of item 12 obtained via reader 69 and the inscription entered by the user.

Figure 4C:
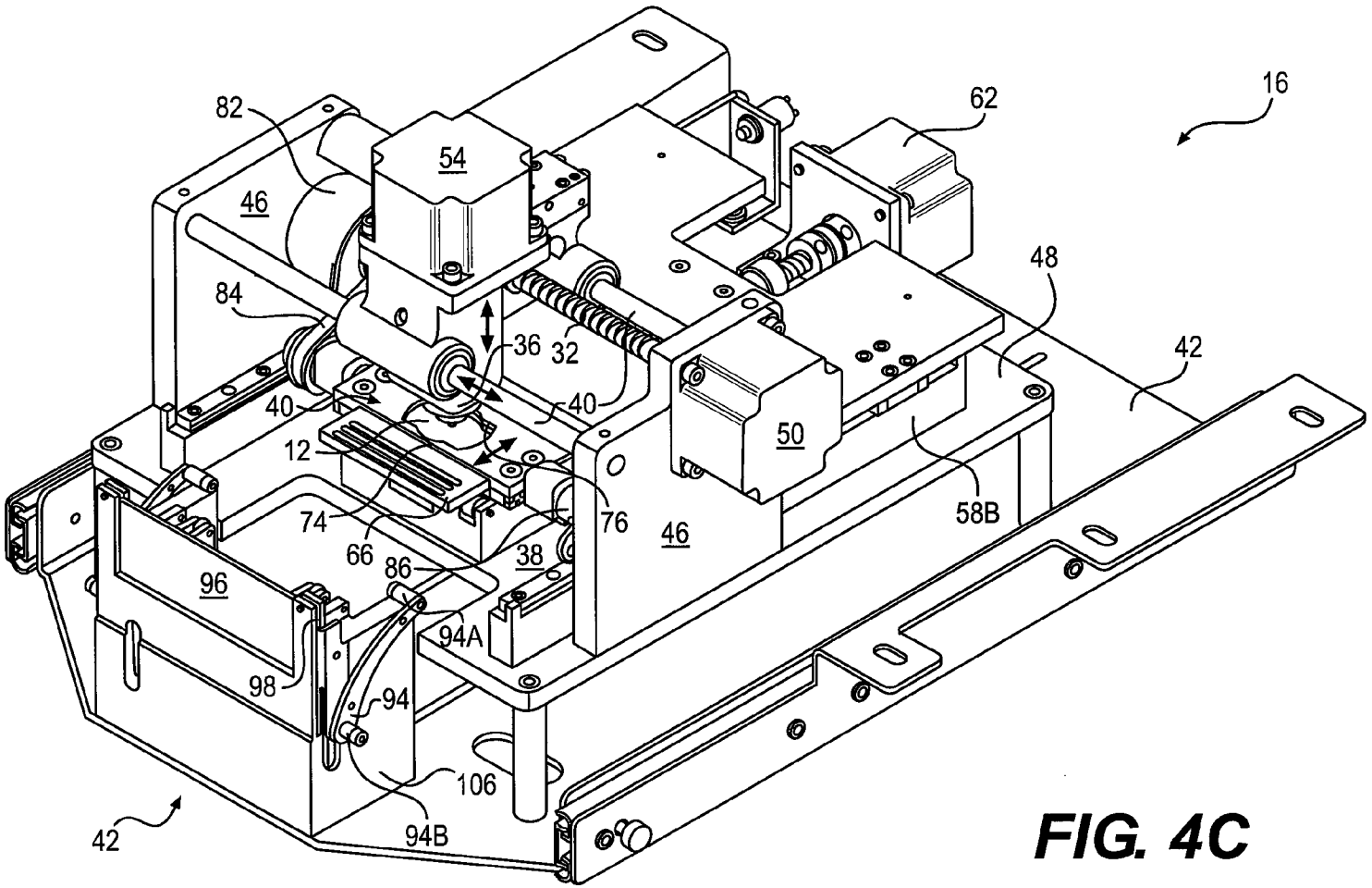
FIG. 4C is a pictorial illustration of the engraving subassembly of FIG. 2 at a third position during the engraving process.

After final positioning of item 12 with respect to engraver 36 has been completed, engraving of the user-selected inscription on one side of item 12 may begin. First stepper motor 50 may move engraver 36 from left to right across the surface of item 12 in the X-direction during engraving by selectively rotating lead screw 52. Second stepper motor 54 may move engraver 36 towards and away from item 12 in the Z-direction during engraving to vary a depth of the resulting inscription in item 12. Thirds stepper motor 62 may rotate lead screw 64 during engraving to move item 12 fore and aft in the Y-direction relative to engraver 36. Fourth stepper motor 82, in most situations, may remain inactive during engraving operations. These operations are shown in FIG. 4C.

Figure 4D:
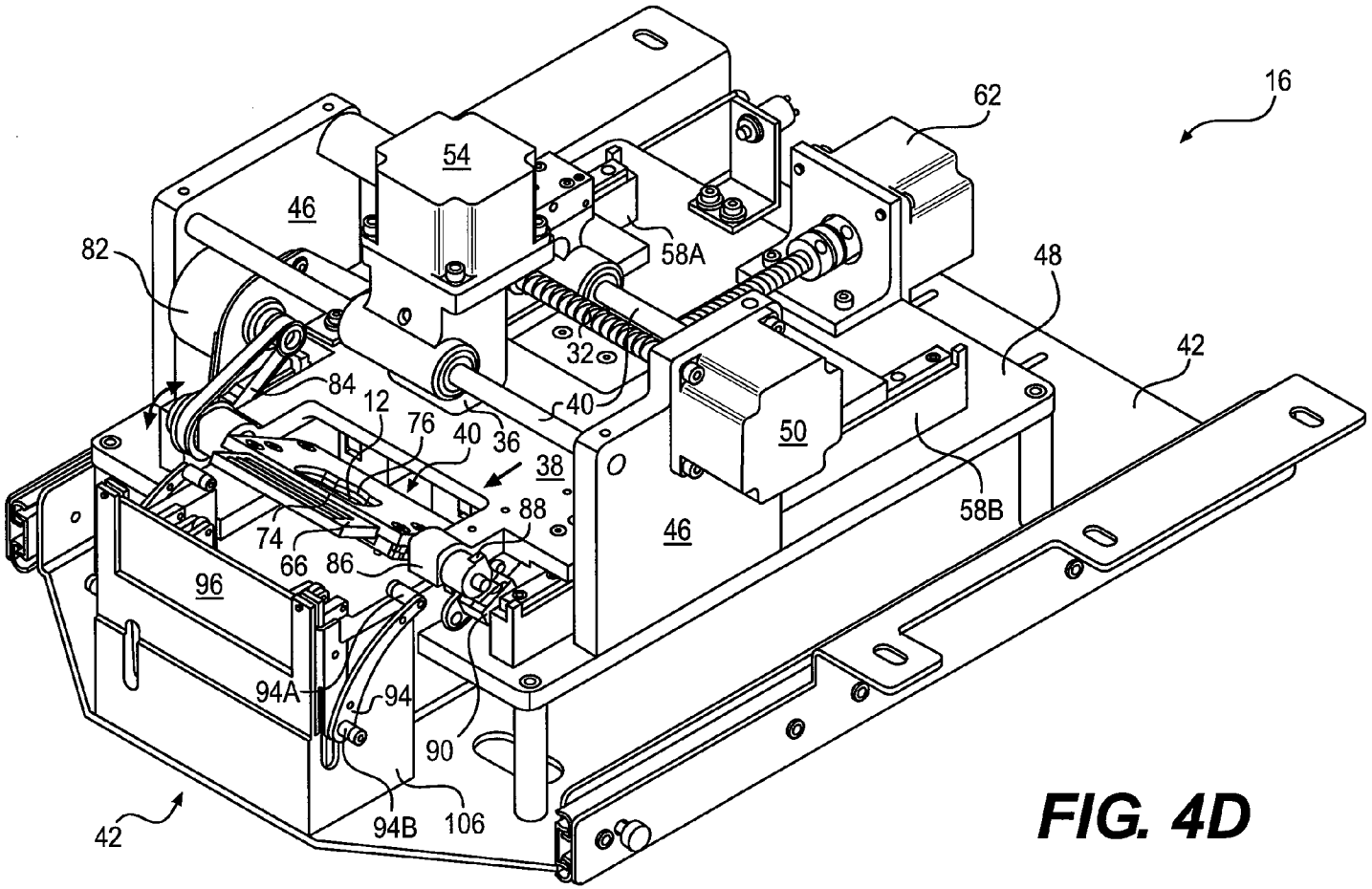
FIG. 4D is a pictorial illustration of the engraving subassembly of FIG. 2 at a fourth position during the engraving process.
Figure 4E:
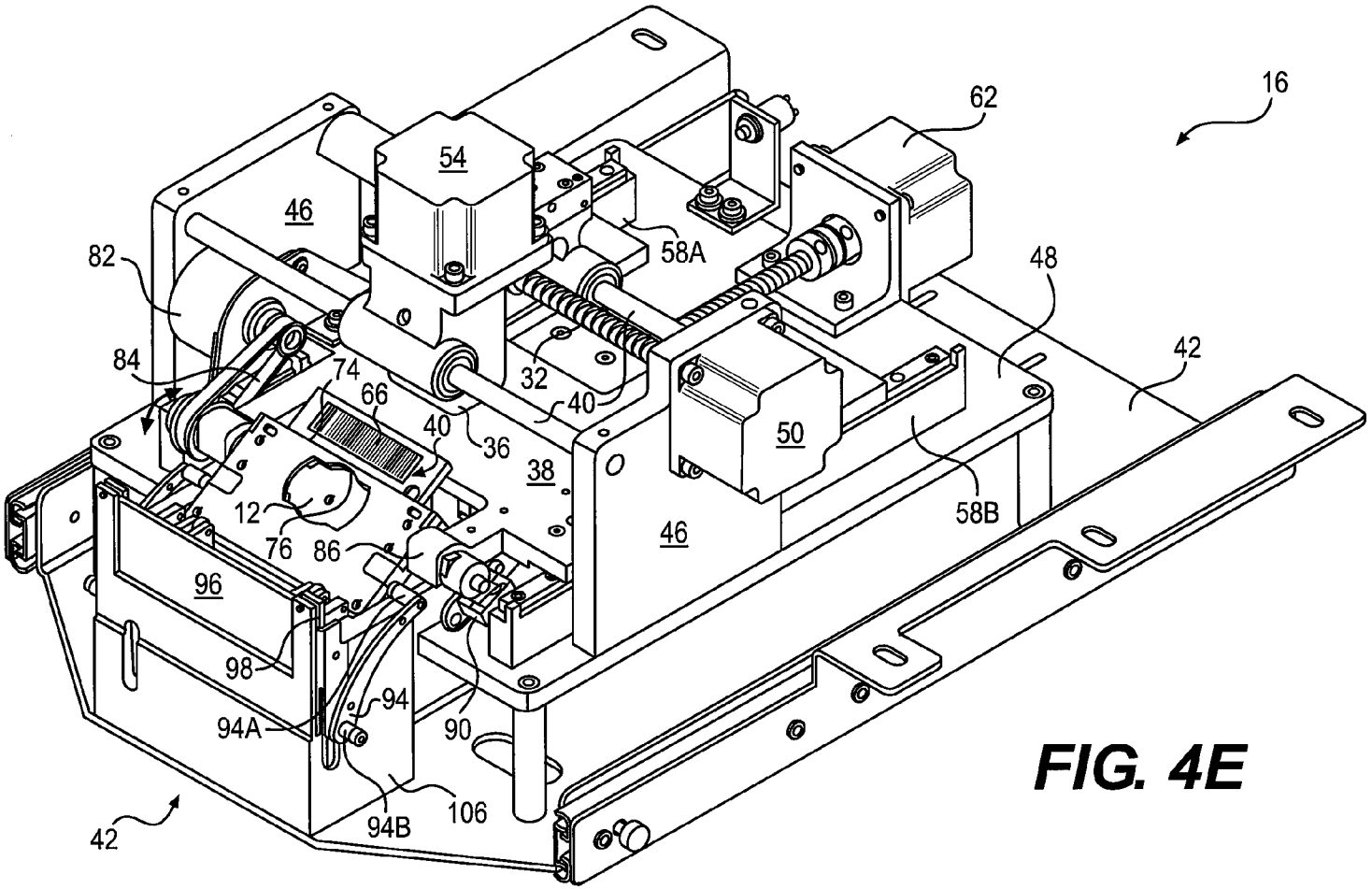
FIG. 4E is a pictorial illustration of the engraving subassembly of FIG. 2 at a fifth position during the engraving process.
Figure 4F:
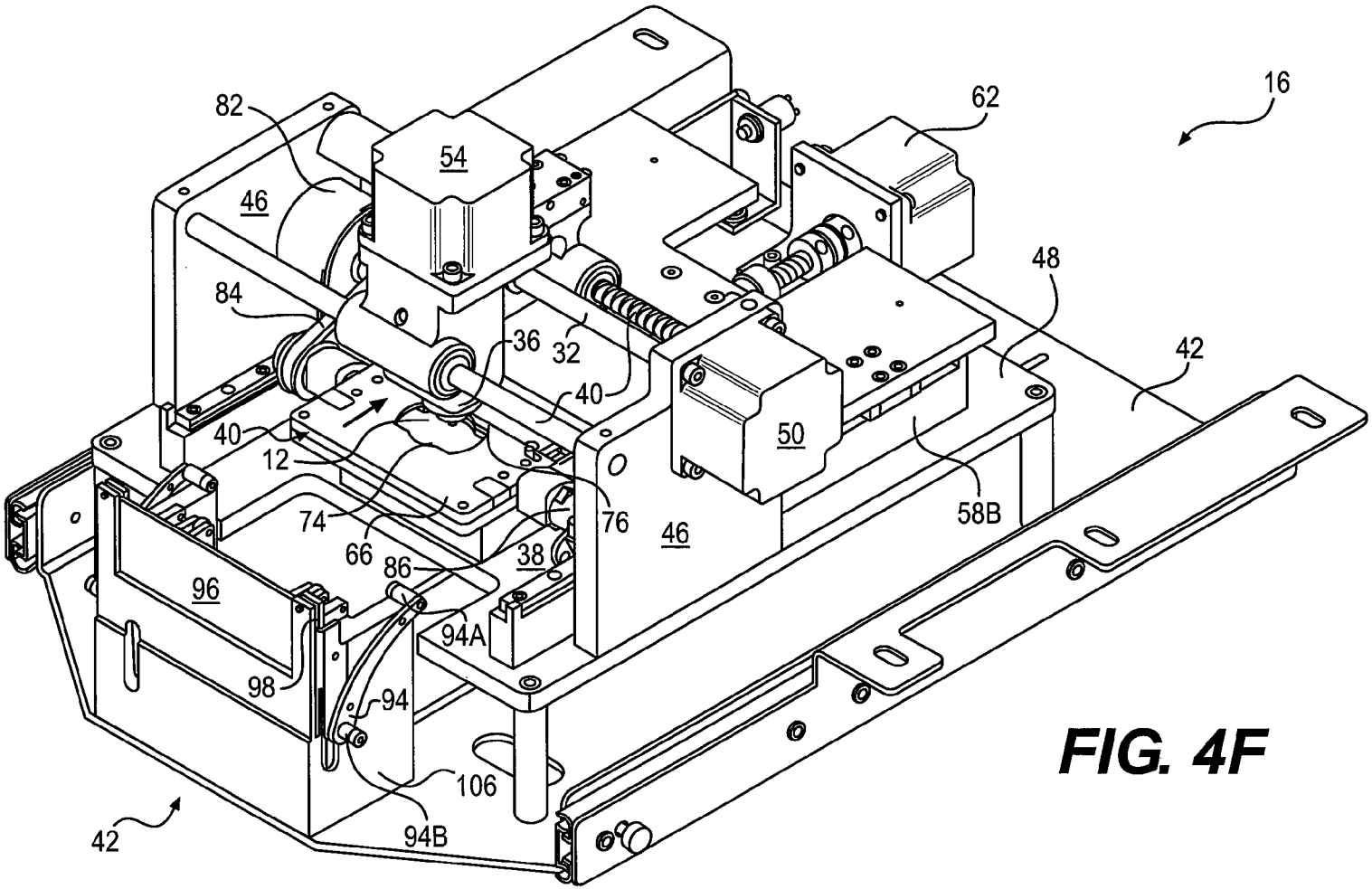
FIG. 4F is a pictorial illustration of the engraving subassembly of FIG. 2 at a sixth position during the engraving process.

Once the first side of item 12 has been engraved, carrier 40 may automatically flip item 12 over for engraving on the opposite side. In particular, controller 20 may activate third stepper motor 62 to back cartridge 66 out from under engraver 36, and then activate fourth stepper motor 82 to flip carrier 40 over. It should be noted that a distance from axis 80 (referring to FIG. 3) to an exposed end of cartridge 66 may be less than a distance from axis 80 to the closed end of carrier 40, thereby ensuring that cartridge 66 will not interfere with base support 38. The now-flipped carrier 40 may be repositioned with respect to engraver 36 for subsequent engraving. These operations are shown in FIGS. 4D-4F.

After the engraving on both sides of item 12 is complete, controller 20 may operate first-fourth stepper motors 50, 54, 62, 82 to return cartridge 66 to the starting position found in FIG. 4A, where the user may retrieve the completed item 12. As base support 38 and carrier 40 approach door mechanism 42, pins (not shown) associated with door mechanism 42 may push against pawls 78 to cause pawls 78 to retract and release cartridge 66. The user may then retrieve the engraved item 12 through opening 34 in door 26 by pulling the exposed end of cartridge 66. Carrier 40 may remain in the position of FIG. 4A in anticipation of the next engraving operation.

Many benefits may be realized because engraving system 10 provides for inscription on both sides of item 12 during a single engraving procedure. In particular, the user may only be required to load item 12 into engraving system 10 once, thereby reducing the effort require of the user. In addition, a single loading event may help reduce the opportunity for error in the engraving process.

It will be apparent to those skilled in the art that various modifications and variations can be made to the disclosed engraving system. Other embodiments will be apparent to those skilled in the art from consideration of the specification and practice of the disclosed engraving system. It is intended that the specification and examples be considered as exemplary only, with a true scope being indicated by the following claims and their equivalents.

What is claimed is:

1. An engraving system operable to engrave a user-loaded item, the engraving system comprising:

a housing;

an engraver located within the housing; and a carrier configured to receive from a user a cartridge holding the item to be engraved and to position the cartridge relative to the engraver, wherein:

the carrier includes at least two windows on opposing sides of the carrier to provide the engraver access to opposing sides of the item;

the engraver is configured to engrave the item via windows in the cartridge; and the carrier is configured to flip the cartridge relative to the engraver for engraving on multiple sides of the item.

2. The engraving system of claim 1, further including:

a base support movable in a direction from an opening in the housing towards the engraver, wherein the carrier is rotatably connected to the base support; and a motor fixedly connected to the base support and operatively connected to rotate the carrier.

3. The engraving system of claim 2, further including:

a cam mechanism operatively connected to rotate with the carrier; and at least one switch associated with the cam mechanism, the at least one switch being configured to generate a signal indicative of an orientation of the carrier relative to the base support, wherein the motor is operated based on the signal.

4. The engraving system of claim 2, further including a door configured to selectively close off an opening in the housing during retraction of the carrier towards the engraver.

5. The engraving system of claim 4, wherein the base support engages an arm pivotally connected to the door to open the door against a spring bias during movement of the carrier towards the opening of the housing.

6. The engraving system of claim 2, further including:

at least one bearing located under the base support to support movement of the base support; and at least one roller located under the carrier to support the carrier during engraving operations.

7. The engraving system of claim 1, wherein the carrier is configured to slidingly receive the item.

8. The engraving system of claim 1, wherein all moving components of the engraving system are mounted to a rack that is slidingly received within the housing.

9. The engraving system of claim 1, wherein the housing includes:

a frame;

at least one hinge slidingly connected to the frame; and a door pivotally connected to the at least one hinge.

10. The engraving system of claim 9, further including at least one alignment feature located on the frame opposite the at least one hinge relative to an opening in the housing, the door having a corresponding alignment feature configured to engage the at least one alignment feature located on the frame.

11. The engraving system of claim 1, further including an operator interface configured to:

receive operator selected inscriptions; and display the operator selected inscriptions on images of opposing surfaces of the item.

12. The engraving system of claim 1, further including a locking mechanism configured to lock the cartridge in the carrier.

13. The engraving system of claim 1, further including a reader situated to read coded indicia corresponding to the item as the carrier moves the item from an opening of the housing towards the engraver.

14. The engraving system of claim 13, wherein the coded indicia is located on the cartridge and is indicative of characteristics of the item held within the cartridge.

15. The engraving system of claim 1, wherein the cartridge has at least two windows substantially matching the two windows of the carrier.

16. An engraving system operable to engrave a user-loaded item, the engraving system comprising:

a housing;

an engraver located within the housing;

a base support movable in a direction from an opening in the housing towards the engraver;

a carrier rotatably connected to the base support and configured to receive from a user the item to be engraved and to position the item relative to the engraver;

at least one bearing located under the base support to support movement of the base support; and at least one roller located under the carrier to support the carrier during engraving operations.

17. The engraving system of claim 16, further including a motor fixedly connected to the base support and operatively connected to rotate the carrier.

18. The engraving system of claim 17, further including:

a cam mechanism operatively connected to rotate with the carrier; and at least one switch associated with the cam mechanism, the at least one switch being configured to generate a signal indicative of an orientation of the carrier relative to the base support, wherein the motor is operated based on the signal.

19. The engraving system of claim 17, further including a door configured to selectively close off the opening in the housing during retraction of the carrier towards the engraver.

20. The engraving system of claim 19, wherein the base support engages an arm pivotally connected to the door to open the door against a spring bias during movement of the carrier towards the opening of the housing.

21. The engraving system of claim 17, wherein the carrier is configured to slidingly receive the item.

22. The engraving system of claim 17, wherein all moving components of the engraving system are mounted to a rack that is slidingly received within the housing.

23. The engraving system of claim 17, wherein the housing includes:

a frame;

at least one hinge slidingly connected to the frame; and a door that is pivotally connected to the at least one hinge.

24. The engraving system of claim 23, further including at least one alignment feature located on the frame opposite the at least one hinge relative to an opening in the housing, the door having a corresponding alignment feature configured to engage the at least one alignment feature located on the frame.

25. The engraving system of claim 17, further including an operator interface configured to:

receive operator selected inscriptions; and display the operator selected inscriptions on images of opposing surfaces of the item.

26. The engraving system of claim 17, further including a reader situated to read coded indicia associated with the item as the carrier moves the item from an opening of the housing towards the engraver.

27. The engraving system of claim 17, wherein the carrier includes at least two windows on opposing sides of the carrier to provide the engraver access to opposing sides of the item.

28. An engraving system operable to engrave a user-loaded item, the engraving system comprising:

a housing;

an engraver located within the housing;

a carrier configured to receive from a user a cartridge holding the item to be engraved and to position the cartridge relative to the engraver; and a reader situated to read coded indicia corresponding to the item as the carrier moves the item from an opening of the housing towards the engraver.

29. The engraving system of claim 28, further including:

a cam mechanism operatively connected to rotate with the carrier; and at least one switch associated with the cam mechanism, the at least one switch being configured to generate a signal indicative of an orientation of the carrier relative to the base support.

30. The engraving system of claim 28, further including a door configured to selectively close off an opening in the housing during retraction of the carrier towards the engraver.

31. The engraving system of claim 28, wherein the carrier is configured to slidingly receive the item.

32. The engraving system of claim 28, wherein all moving components of the engraving system are mounted to a rack that is slidingly received within the housing.

33. The engraving system of claim 28, wherein the housing includes:

a frame;

at least one hinge slidingly connected to the frame; and a door that is pivotally connected to the at least one hinge.

34. The engraving system of claim 33, further including at least one alignment feature located on the frame opposite the at least one hinge relative to an opening in the housing, the door having a corresponding alignment feature configured to engage the at least one alignment feature located on the frame.

35. The engraving system of claim 28, further including an operator interface configured to:

receive operator selected inscriptions; and display the operator selected inscriptions on images of opposing surfaces of the item.

36. The engraving system of claim 28, wherein the carrier includes at least two windows on opposing sides of the carrier to provide the engraver access to opposing sides of the item.

37. An engraving system operable to engrave a user-loaded item, the engraving system comprising:

a housing;

an engraver located within the housing;

a base support movable in a direction from an opening in the housing towards the engraver;

a carrier configured to receive from a user a cartridge holding the item to be engraved, to position the cartridge relative to the engraver for engraving of the item via windows in the cartridge, and to flip the cartridge relative to the engraver for engraving on multiple sides of the item;

at least one bearing located under the base support to support movement of the base support;

at least one roller located to support the carrier during engraving operations; and a reader situated to read coded indicia associated with the item as the carrier moves the item from an opening of the housing towards the engraver.

38. A method of engraving an item, comprising:

receiving from a user a cartridge containing the item to be engraved;

positioning the cartridge relative to an engraver;

reading from the cartridge coded indicia corresponding to characteristics of the item as the cartridge is positioned relative to the engraver; and flipping the cartridge relative to the engraver for engraving on multiple sides of the item via windows in the cartridge.

39. The method of claim 38, further including:

sensing a flip angle of the item; and responsively adjusting the flip angle to place the item in a plane substantially parallel to a movement plane of the engraver.

40. The method of claim 38, further including selectively blocking user access to the item during retraction of the item towards the engraver.

41. The method of claim 38, further including:

receiving operator selected inscriptions; and displaying the operator selected inscriptions on images of opposing surfaces of the item.

* * * * *